US009443649B2

(12) United States Patent
Hoppe et al.

(10) Patent No.: US 9,443,649 B2
(45) Date of Patent: Sep. 13, 2016

(54) COIL AND SOLENOID VALVE

(75) Inventors: Jens Hoppe, Erlangen (DE); Stefan Konias, Erlangen (DE); Uwe Wunderlich, Graefenberg (DE); Richard Baier, Graefenberg (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 193 days.

(21) Appl. No.: 14/126,206

(22) PCT Filed: Feb. 27, 2012

(86) PCT No.: PCT/EP2012/053280

§ 371 (c)(1),
(2), (4) Date: Apr. 8, 2014

(87) PCT Pub. No.: WO2012/171673

PCT Pub. Date: Dec. 20, 2012

(65) Prior Publication Data

US 2014/0216376 A1 Aug. 7, 2014

(30) Foreign Application Priority Data

Jun. 17, 2011 (DE) ..... 10 2011 077 733

(51) Int. Cl.

| | |
|---|---|
| ***H01F 27/02*** | (2006.01) |
| ***H01F 38/00*** | (2006.01) |
| ***F01L 1/34*** | (2006.01) |
| ***H01F 7/128*** | (2006.01) |
| ***H01F 7/16*** | (2006.01) |
| ***H01F 41/12*** | (2006.01) |
| *F01L 1/344* | (2006.01) |

(52) U.S. Cl.

CPC ..... *H01F 38/00* (2013.01); *F01L 1/34* (2013.01); *H01F 7/128* (2013.01); *H01F 7/1607* (2013.01); *H01F 27/02* (2013.01); *H01F 41/127* (2013.01); *F01L 2001/3443* (2013.01); *Y10T 29/4902* (2015.01)

(58) Field of Classification Search

CPC ..... H01F 27/00–27/30
USPC ..... 336/65, 83, 90–96, 206–208, 220–223
See application file for complete search history.

(56) References Cited

U.S. PATENT DOCUMENTS

| | | | | |
|---|---|---|---|---|
| 7,362,201 | B2 * | 4/2008 | Saegusa | H01F 27/022 336/90 |
| 2011/0220826 | A1 | 9/2011 | Hoppe et al. | |
| 2011/0285484 | A1 | 11/2011 | Hoppe et al. | |

FOREIGN PATENT DOCUMENTS

| | | |
|---|---|---|
| CN | 2628830 | 7/2004 |
| DE | 24 37 905 | 2/1976 |
| DE | 101 25 223 | 12/2002 |

(Continued)

*Primary Examiner* — Tuyen Nguyen
(74) *Attorney, Agent, or Firm* — Davidson, Davidson & Kappel, LLC

(57) ABSTRACT

A coil (4) for a solenoid valve (2) in particular for actuating a camshaft adjuster, including a coil carrier (6) with an underside, a pot (8) with a base on which the underside of the coil carrier (6) is placed and with a wall which forms an intermediate space (16) with respect to the coil carrier (6), and a yoke disk (10) which is placed on the pot (8) with coil carrier (6) and which covers the intermediate space (16), wherein the intermediate space (16) is open via a flow gap (34) between the yoke disk (10) and the coil carrier (6) and/or between the yoke disk (10) and the pot (8) and is provided for receiving a filler (36). The flow gap (34) is formed for the hardening of the filler (36).

11 Claims, 5 Drawing Sheets

(56) References Cited

FOREIGN PATENT DOCUMENTS

| | | | | |
|---|---|---|---|---|
| DE | 10 2009 006355 | | 7/2010 | |
| JP | 2002147637 A | * | 5/2002 | |
| JP | 2008 128 364 | | 6/2008 | |
| SE | WO 9213221 A1 | * | 8/1992 | ..... F16K 31/0606 |
| WO | WO2008062703 | | 5/2008 | |
| WO | WO 2010/060690 | | 6/2010 | |
| WO | WO2010086058 | | 8/2010 | |

* cited by examiner

COIL AND SOLENOID VALVE

The invention concerns a coil for a solenoid in particular for actuating a camshaft adjuster, a solenoid in particular for actuating a camshaft adjuster and a method for manufacturing a coil for a solenoid.

BACKGROUND

A solenoid is an actuator which, in particular by a corresponding actuation, can adjust the through-flow of a fluid, for example, an oil. For example a slide is moved in a solenoid by a tappet that is controlled by a magnetic field excited through electric energy.

The slide of the solenoid is usually placed on the tappet that is connected to an armature of the solenoid. The armature is moved relative to a yoke disk. For this purpose, the yoke disk bundles the magnetic field that is excited by the coil and transmits this via a pole shoe to the armature.

In a solenoid of the pre-cited type, the coil has to be packaged in a leak-free manner. For this purpose, the coil, as shown for example in WO 2010/060690, comprises a cylindrical coil carrier comprising an underside, a pot with a bottom on which the underside of the coil carrier is placed, and a wall which forms, together with the coil carrier, an intermediate space A yoke disk is placed on the pot with coil carrier and covers the intermediate space.

Because of the tolerances, an undesired gap is formed between the yoke disk and the coil carrier and/or between the yoke disk and the pot. Conventionally, this gap is sealed by injecting a filler material into the intermediate space, and thus into the gap, and/or by pressing the yoke disk onto the pot and the coil carrier in order to compensate for the high tolerances.

SUMMARY OF THE INVENTION

It is an object of the present invention to improve the conventional coil of the solenoid.

The present invention provides that the filler material that has to be injected into the intermediate space to seal the gap, hereinafter referred to as flow gap, should be compacted within the flow gap. If the compacting process takes too much time, the filler material exits again from the side of the flow gap situated opposite the intermediate space and must be removed from there by a complicated step, so that the duration of the production cycles of the coil is prolonged. The invention is therefore based on the idea of compacting the filler material already in the interior of the flow gap so that the flow gap is sealed by the filler material itself. In this way, it is assured that no filler material can exit on the side of the intermediate space on the side of flow gap situated opposite the intermediate space so that not only additional work steps for removing the filler material from the coil are avoided, but the filler material that has to be removed is also saved.

The invention therefore proposes a coil for a solenoid in particular for actuating a camshaft adjuster, which coil comprises a cylindrical coil carrier with an underside, a pot with a bottom on which the underside of the coil carrier is placed and a wall which forms, together with coil carrier, an intermediate space, as well as a yoke disk placed on the pot with coil carrier, which yoke disk covers the intermediate space, said intermediate space being open via a flow gap between the yoke disk and the coil carrier and/or between the yoke disk and the pot and being provided for receiving a filler material. The flow gap is configured for enabling the hardening of the filler material.

Fundamentally, air can escape from the intermediate space via the flow gap when filler material is filled in so that a so-called diesel effect can be avoided which is caused by a compression of the air and manifests itself in the form of damaged points in the filler material because these are scorched by the compressed, and thus strongly heated air.

The flow gap is provided for enabling a freezing in or hardening of the filler material by which is to be understood a compacting of the filler material. If the filler material is a plastic, the freezing in or hardening includes the polymerization of the plastic till this is compacted. If the plastic is a thermo plastic, the hardening includes hardening of the thermo plastic by cooling. Such a hardening or freezing in can also be assured in any imaginable manner, such as for example even by active cooling. Preferably, the flow gap, which has a certain volume and can thus accommodate a certain amount of filler material, can be limited in its opening area to the intermediate space. In this way, the amount of filler material that can be filled into the flow gap is limited and, additionally, the flowing speed of the filler material within the flow gap is reduced so that the filler material can remain in the flow gap long enough to harden by cooling or by polymerization or as a result of other time-controlled processes.

The limitation of the opening area to the intermediate space can be realized in many ways. Additionally or alternatively, it is further possible to widen the cross-section of the flow gap as viewed from the opening area to the intermediate space, so that the filler material flows more slowly the further it penetrates into the flow gap. For improving this effect, the cross-section can be narrowed again from a certain depth on in the flow gap in order to further limit the flowing speed of the incipiently hardened filler material and to further improve the freezing in effect.

Alternatively, according to a further preferred embodiment, the flow gap can be made longer than the shortest distance between the intermediate space and an outer space in which case, the pot, the yoke disk and the coil carrier separate the intermediate space from the outer space. Due to this lengthening and by reason of the resulting longer time span, the filler material is hardened before it can exit out of the flow gap. The lengthening can be realized for example in that the yoke disk is embedded in the coil and/or in the pot so that the flow gap, starting at the support surface of the yoke disk extends along a peripheral edge of the yoke disk in direction of a covering surface situated opposite the support surface of yoke disk.

In a particularly preferred embodiment, the flow gap has a labyrinth-like configuration. For achieving this, the flow gap is turned round a number of times between the inner space and the outer space, so that it does not extend along a straight path from the intermediate space to the outer space. This turning-round further reduces the flowing speed of the filler material, constitutes a further flow resistance and lengthens the path of exit or flow. This enhances the freezing in effect i.e. it is favorable for the hardening of the filler material before its exit. This labyrinth configuration particularly results in a lengthening of the flow path which guarantees a freezing in of the filler material, independently of the height tolerances of the components.

In a further development, the coil carrier, the pot and the yoke disk are configured rotationally symmetric to an axis of rotation, the flow gap, as viewed in direction of the axis of rotation, extending in axial direction and being configured as a labyrinth in radial direction. Such a flow gap is realized in that, in particular, the support surface between the yoke disk and the coil carrier and/or the support surface between the coil carrier and the pot are appropriately modified to match the labyrinth to be created. Further modifications to the coil are not necessary, so that the proposed coil can be used in a conventional solenoid without further modifications to the solenoid.

In one preferred further development, the flow gap is formed by a groove into which an elevation engages. In this way, an inherent positioning aid is created for the yoke disk because the elevation can only engage into the groove when the yoke disk is correctly placed on the coil carrier and/or on the pot.

In one particularly preferred further development, the yoke disk comprises the groove. This can then be realized through a usual punching method and can be made with the usual tolerances without further finishing steps. In the same way, the coil carrier can comprise the elevation. This enables the manufacturing of the coil carrier with the elevation in one piece for instance by extrusion molding so that no further finishing is required. The tolerances of the punched groove and the integral elevation can then be completely compensated for with the filler material.

Advantageously, the intermediate space comprises at least one vent opening in the region of the underside of the coil carrier. These openings can be provided in addition to the aforesaid flow gap. In an independent invention, the vent openings are provided without the aforesaid flow gap in the coil described above. Through these openings, air escapes from the underside of the coil carrier when the filler material is being filled in, so that the aforesaid diesel effect on the underside of the coil carrier is likewise avoided. This independent invention, too, improves a coil known from the prior art because damage through a scorching or overheating of the filler material on the underside of the coil carrier during filling in of the filler material is prevented.

In one further development, a cross-section of the vent opening can be made so small that no filler material can escape through the vent opening. In this way, an after treatment of the coil, for example by deburing, due to escaped filler material is avoided. Thus, by reason of the viscosity of the filler material, the filler material cannot penetrate into the vent openings under the respective prevailing pressure conditions, or it sets or core-hardens as a result of the reduced quantity due to the small cross-section.

In one special embodiment, the coil carrier, the pot and the yoke disk are configured rotationally symmetric to an axis of rotation. In this case, the further openings can be formed by grooves extending radially with respect to the axis of rotation in the bottom of the pot. The technical realization of these grooves in the bottom of the pot is achieved technically by stamping which is a material, time and energy saving method.

In a further embodiment, the filler material can be received in the intermediate space. The filler material protects the intermediate space from penetrating impurities and enhances the durability of the coil.

The invention also provides a solenoid in particular for actuating a camshaft adjuster, said solenoid comprising a coil of the above-described type possessing the aforesaid features, an armature movable by electrically energizing the coil and a tappet connected to the armature for moving a slide.

The invention also provides a method for manufacturing a coil for a solenoid, comprising a coil carrier with an underside, a pot with a bottom on which the underside of the coil carrier is placed, and a wall which forms, together with coil carrier, an intermediate space and a yoke disk which is placed on the pot with coil carrier and covers the intermediate space, said intermediate space being open via a flow gap between the yoke disk and the coil carrier and/or between the yoke disk and the pot. The method comprises the following steps: placing at disposal a yoke disk, stamping a peripheral groove into the yoke disk in the region of the flow gap, manufacturing the coil carrier with a peripheral elevation in the region of the flow gap, placing at disposal the pot, inserting the coil carrier into the pot, seating the yoke disk on the pot such that the elevation engages into the groove, and filling up the intermediate space with filler material.

In one special embodiment, the method provided includes injecting a filler material into the intermediate space through an aperture in the yoke disk.

BRIEF DESCRIPTION OF THE DRAWINGS

The invention will now be described more closely with reference to a drawing. The figures show.

DETAILED DESCRIPTION

Figure 1:
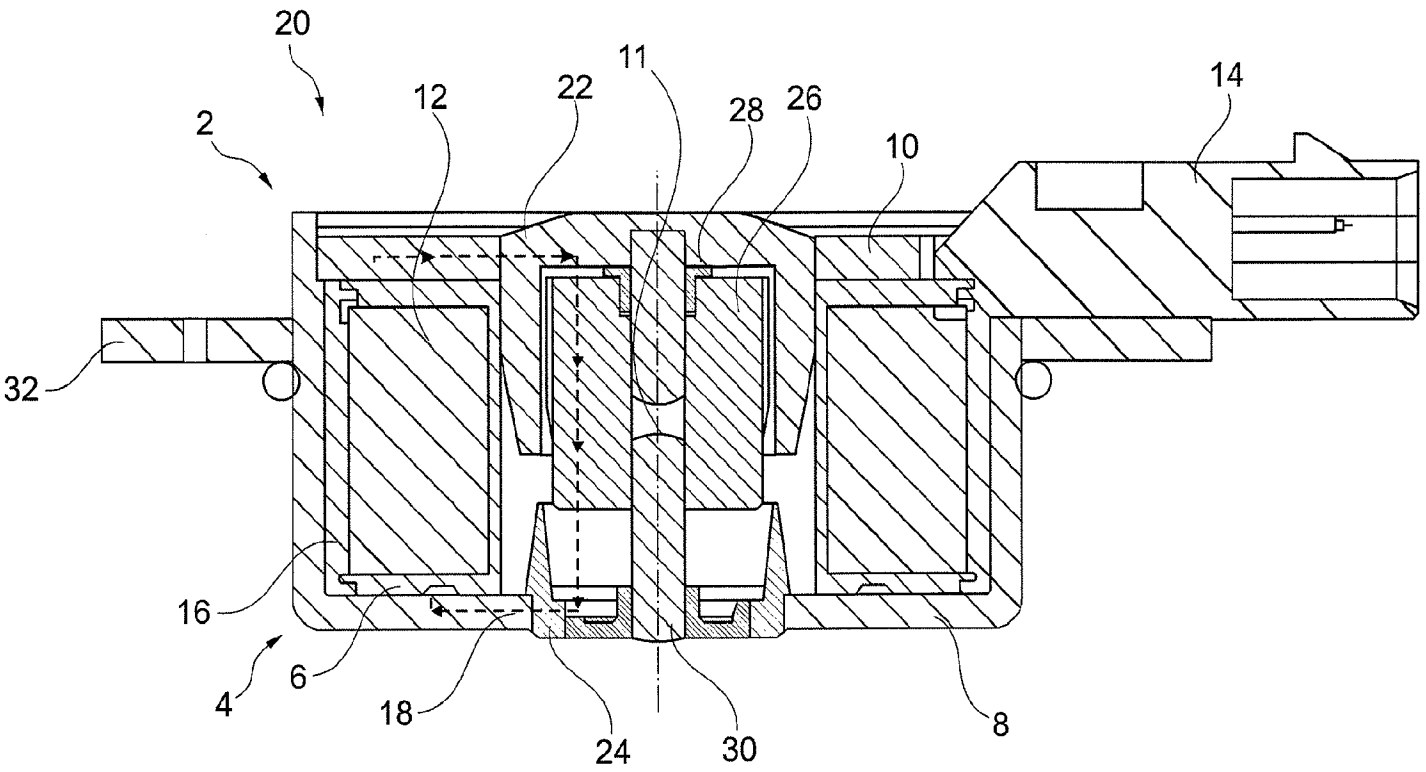
FIG. 1, a longitudinal cross-section of a solenoid comprising a coil.

FIG. 1 shows a longitudinal cross-section of a solenoid 2 comprising a coil 4. The solenoid 2 can be configured as a hydraulic directional valve in a central valve and arranged radially within an inner rotor of a device for variable adjustment of the valve timing in an internal combustion engine.

The coil 4 comprises a cylindrical coil carrier 6, a pot 8 and a yoke disk 10 and is configured rotationally symmetric to an axis of rotation 11. In the coil carrier 6 is embedded a coil wire 12 which can be electrically energized through a plug contact 14. The coil carrier 6, the pot 8 and the yoke disk 10 together define an intermediate space 16 which can be filled with a filler material like plastic so that the coil wire 12 is completely injected over with the filler material.

The magnetic field 18 which can be generated by the coil wire 12 is transmitted to an axially movable armature 26 via a soft iron circuit 20 comprising a yoke 22, the yoke disk 10, a pole core 24 and the pot 8. FIG. 1 shows the magnetic field 18 in a strongly simplified illustration and does not correspond, especially on the underside of the coil carrier 6, to the real path. The magnetic field 18 exerts a magnetic force on the armature 26 via an air gap 28 situated between the pole core 18 and the armature 26. A resulting movement of the armature 26 is transmitted via a pressure pin or tappet 30 to a piston of the central valve (not shown).

The solenoid 2 is fixed through a flange 32 of the pot 8 on the central valve or on a housing surrounding the central valve.

After the pot 8 with the coil carrier 6 and the yoke disk 10 has been closed, there remains a gap between the coil carrier 6 and the yoke disk 10 due to the manufacturing tolerances. When the coil wire 12 is injected over with the filler material, the filler material exits out of this flow gap and must be removed after it has hardened so that it does not obstruct the yoke 22 when this is inserted.

As described below, in order to avoid the unnecessary removal of the exiting filler material, the flow gap is configured such that the filler material freezes in or hardens within the flow gap.

Figure 2:
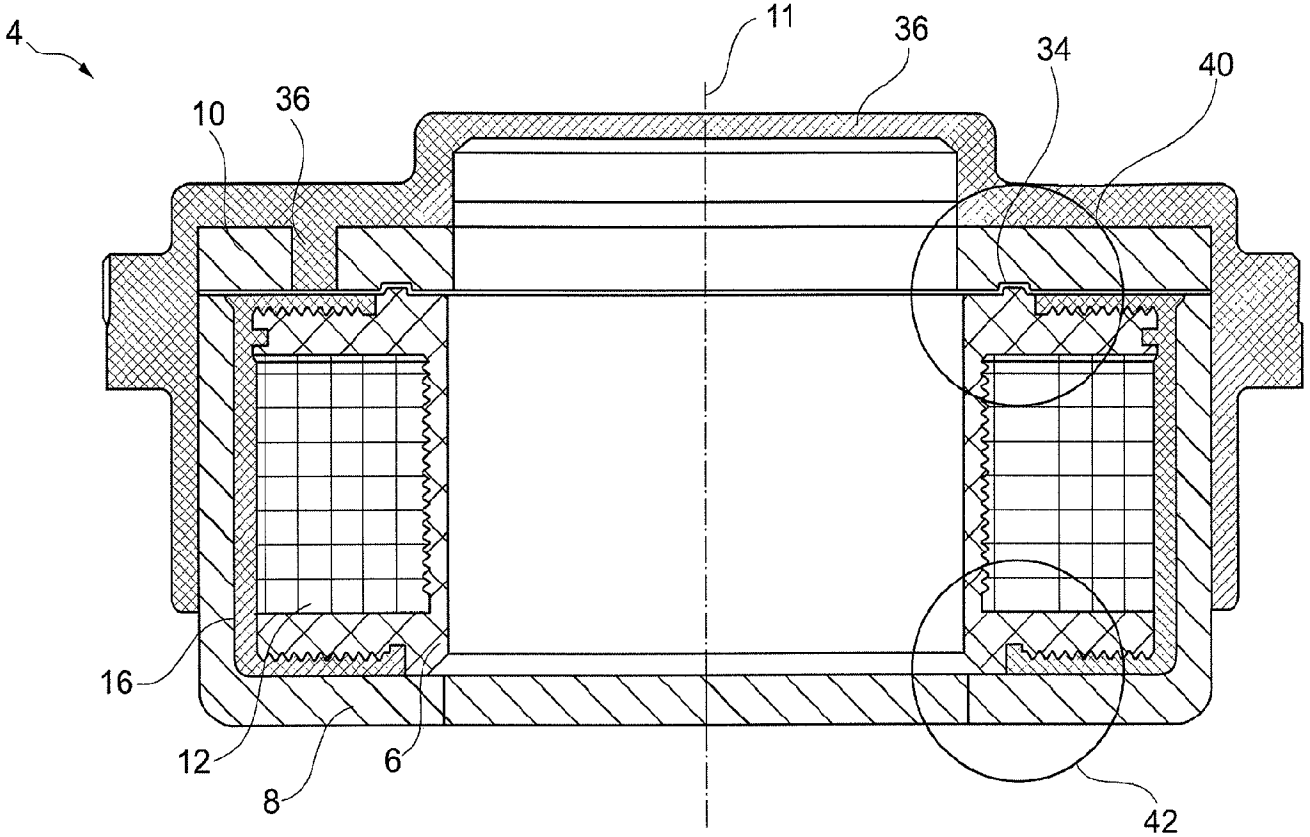
FIG. 2, a longitudinal cross-section of a coil comprising a flow gap and openings on its underside.

FIG. 2 shows a longitudinal cross-section of the coil 4 comprising a flow gap 34 as well as further openings on the underside of the coil 4. Those elements of FIG. 2 which are identical to elements of FIG. 1 are identified by the same reference numerals and are not described once more.

In FIG. 2, the intermediate space 16 is completely filled with the filler material 36. The filler material 36 is injected into the intermediate space 16 through an opening 38 in the yoke disk 10.

In the following, the region 40 around the flow gap 34 and a region 42 on the underside of the coil 4 will be described more closely.

Figure 3:
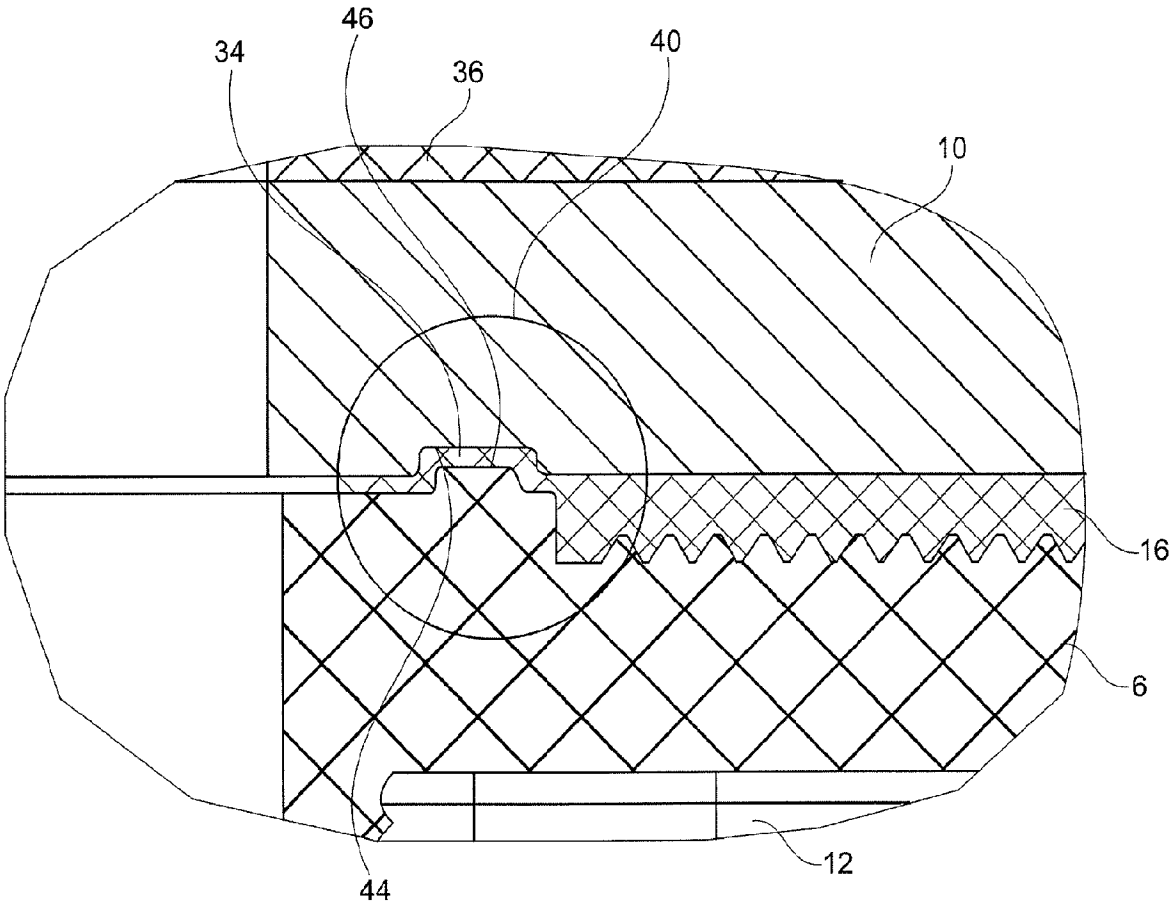
FIG. 3, a longitudinal cross-section of the flow gap of FIG. 2.

FIG. 3 shows a section out of FIG. 2 including the region 40. Those elements of FIG. 3 which are identical to elements of FIGS. 1 and 2 are identified by the same reference numerals and are not described once more.

The flow gap 34 has a labyrinth-like shape and is formed in the yoke disk 10 with help of a groove 44 into which an elevation 46 of the coil carrier 6 is inserted. When the filler material 36 is flowing into this labyrinth-like flow gap 34, the multiple diversions of the filler material 36 lead to an on-time freezing-in or hardening of the filler material in the flow gap 34 before the filler material can exit on the inner side. Due to the lengthening of the flow path, the filler material hardens already within the flow gap 34. The narrower the flow gap 34 is configured, the stronger is the freezing-in or hardening effect.

At the same time, air can escape through the labyrinth-like flow gap 34, so that a diesel effect at this point is avoided.

The operative, labyrinth-like flow gap 34 can be made with usual stamping and/or injection molding tolerances without finishing steps and can thus compensate completely for the high tolerances of the coil 4.

Figure 4:
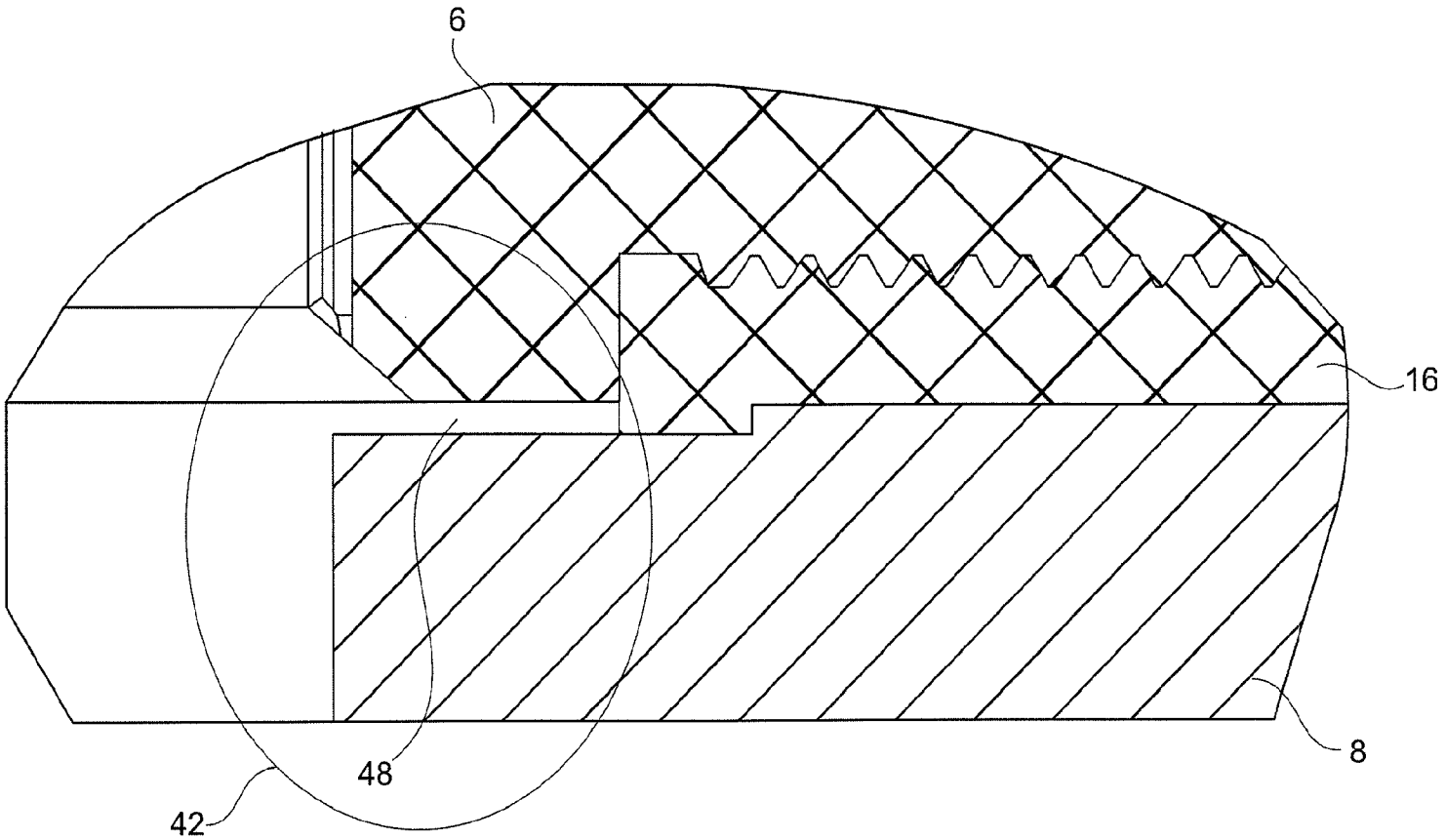
FIG. 4, a longitudinal cross-section of the openings of FIG. 2.
Figure 5:
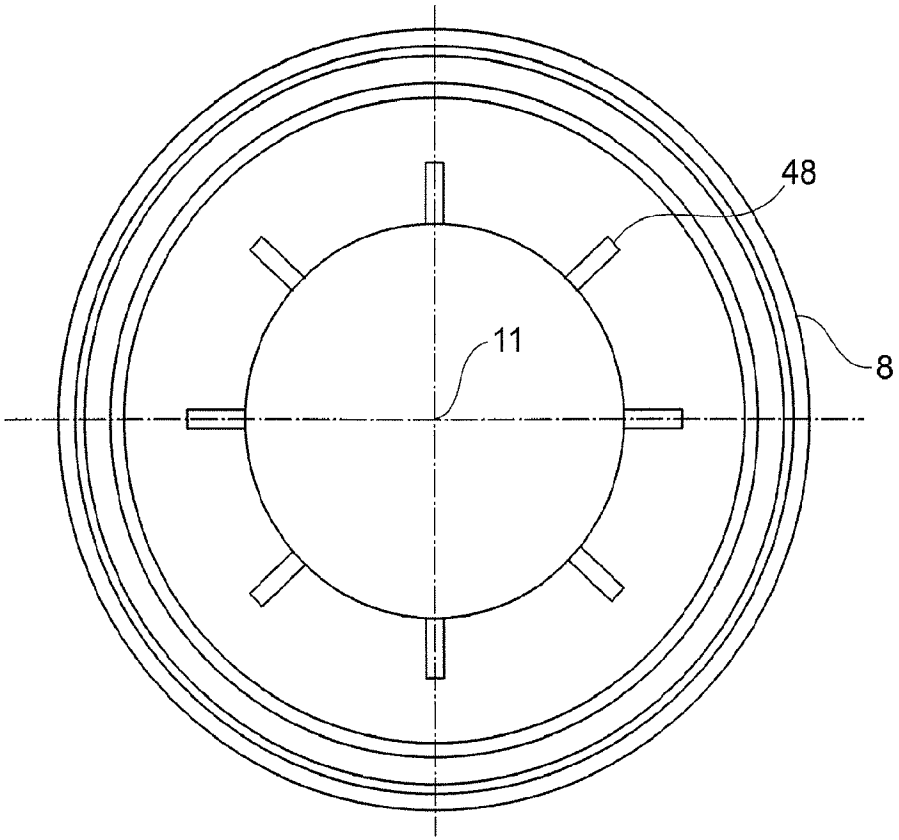
FIG. 5, a top view of the pot of FIG. 2.

FIG. 4 shows a section out of FIG. 2 with the region 42 and FIG. 5 shows a top view of the pot 8. Those elements of FIGS. 4 and 5 which are identical to elements of FIGS. 1 and 2 are identified by the same reference numerals and are not described once more.

On the underside of the coil 4, depressions 48 are stamped into the pot 8 and extend radially in a direction away from the axis of rotation 11. For the sake of clarity only one of the depressions 48 is identified by a reference numeral in FIG. 5.

When the filler material is being filled in or injected, air can escape via the depressions 48 but not the filler material 36. Thus, at this point, too, the occurrence of a diesel effect during the step of injecting the filler material 36 around the coil wire 12 is avoided. At the same time, no exact inner diameter tolerances are required of the deep drawn pot 8 for sealing the filler material 36.

LIST OF REFERENCE NUMERALS

2 Solenoid
4 Coil
6 Coil carrier
8 Pot
10 Yoke disk
11 Axis of rotation
12 Coil wire
14 Plug contact
16 Intermediate space
18 Magnetic field
20 Soft iron circuit
22 Yoke
24 Pole core
26 Armature
28 Air gap
30 Pressure pin or tappet
32 Flange
34 Flow gap
36 Filler material
38 Aperture
40 Region
42 Region
44 Groove
46 Elevation
48 Depression

The invention claimed is:

1. A coil for a solenoid, the coil comprising:
a coil carrier with an underside;
a pot having a bottom, the underside of the coil carrier being placed on the bottom, and a wall, the wall forming, together with coil carrier, an intermediate space; and
a yoke disk placed on the pot, the yoke disk covering the intermediate space, the intermediate space being open via a flow gap between the yoke disk and the coil carrier or between the yoke disk and the pot and being provided for receiving a filler material, the flow gap configured for enabling a hardening of the filler material, the flow gap having the hardened filler material.

2. The coil as recited in claim 1 wherein the flow gap has a labyrinth configuration.

3. The coil as recited in claim 2 wherein the coil carrier, the pot and the yoke disk are configured rotationally symmetric to an axis of rotation, the flow gap, as viewed in a direction of the axis of rotation, extends in an axial direction and having the labyrinth configuration in radial direction.

4. The coil as recited in claim 1 wherein the flow gap is formed by a groove, an elevation engaging into the groove.

5. The coil as recited in claim 4 wherein the yoke disk surrounds the groove, and the coil carrier includes the elevation.

6. The coil as recited in claim 1 wherein the intermediate space includes at least one vent opening in a region of the underside of the coil carrier, air capable of escaping through the vent opening and out of the intermediate space when the filler material is being injected.

7. The coil as recited in claim 6 wherein a cross-section of the vent opening is configured such that an escape of filler material through the vent opening is prevented.

8. The coil as recited in claim 6 wherein the coil carrier, the pot and the yoke disk are configured rotationally symmetric to an axis of rotation, the at least one vent opening including a plurality of openings formed by grooves extending radially with respect to the axis of rotation in the bottom of the pot.

9. A solenoid comprising:
a coil as recited in claim 1;
an armature movable by electrically energizing the coil; and
a tappet connected to the armature for moving a slide.

10. A camshaft adjuster actuator comprising the solenoid as recited in claim 9.

11. A camshaft adjuster actuator comprising the coil as recited in claim 1.

* * * * *